US005999782A

United States Patent [19]

Iguchi et al.

[11] Patent Number: 5,999,782

[45] Date of Patent: Dec. 7, 1999

[54] DEVELOPING DEVICE HAVING AN AC CURRENT WITH TWO FREQUENCIES AND METHOD OF USING SAME

[75] Inventors: Yoshiyuki Iguchi, Takarazuka; Yoshio Sakagawa, Ibaraki; Tamotsu Shimizu, Settsu, all of Japan

[73] Assignee: Minolta Co., Ltd., Osaka, Japan

[21] Appl. No.: 09/115,509

[22] Filed: Jul. 15, 1998

[30] Foreign Application Priority Data

Jul. 29, 1997 [JP] Japan ..... 9-202727

[51] Int. Cl.[6] ..... G03G 15/08; G03G 15/09

[52] U.S. Cl. ..... 399/270

[58] Field of Search ..... 399/232, 270, 399/285

[56] References Cited

U.S. PATENT DOCUMENTS

| | | | |
|---|---|---|---|
| 4,610,531 | 9/1986 | Hayashi et al. | 399/270 |
| 4,688,923 | 8/1987 | Kohyama | 399/138 |
| 5,307,127 | 4/1994 | Kobayashi et al. | 399/270 X |
| 5,424,812 | 6/1995 | Kemmochi et al. | 399/270 |
| 5,532,801 | 7/1996 | Mizoguchi | 399/232 |
| 5,534,982 | 7/1996 | Sakaizawa et al. | 399/270 |
| 5,554,479 | 9/1996 | Ochiai et al. | 399/270 X |
| 5,565,966 | 10/1996 | Ochiai et al. | 399/270 X |
| 5,602,630 | 2/1997 | Endo et al. | 399/271 |

FOREIGN PATENT DOCUMENTS 5-119592 5/1993 Japan .

*Primary Examiner*—Fred L. Braun
*Attorney, Agent, or Firm*—Burns, Doane, Swecker & Mathis, LLP

[57] ABSTRACT

A developing device capable of producing images having excellent image density and texture without density irregularities, which includes a developer carrier disposed opposite the image carrier and transporting a developer hell on its surface to a developing region and a voltage supplying unit which applies an alternating current voltage to the developer carrier, the alternating current voltage having a first frequency during a first action period and a second frequency during a second action period, the first action period and the second action period being alternately repeated, the second frequency being higher than the first frequency.

24 Claims, 5 Drawing Sheets

PRIOR ART

DEVELOPING DEVICE HAVING AN AC CURRENT WITH TWO FREQUENCIES AND METHOD OF USING SAME

RELATED APPLICATIONS

The present invention is based on Japanese Patent application No. HEI 9-202727, the content of which is incorporated herein by reference.

BACKGROUND OF THE INVENTION

1. Field of the Invention

The present invention relates to a developing device used to develop an electrostatic latent image formed on an image carrier in an image forming apparatus such as a copier, printer or the like.

2. Description of the Related Art

Various types of developing devices are conventionally used for developing electrostatic latent images formed on an image carrier in image forming apparatuses such as copiers, printers and the like.

One such developing device, for example, is shown in FIG. 5. A cylindrical developer-carrying member 111 provided with an internal magnet roller 111*a* is disposed opposite an image-carrying member 101 in body 110 of a developing device. A developer supplying member 112 such as a bucket roller or the like supplies developer 102 accommodated in body 110 to the surface of the developer carrier 111. Developer 102 is maintained on the surface of the developer carrier 111 by the magnetic force of the magnet roller 111*a*, and is transported via the rotation of the developer carrier 111. A regulating member 113 regulates the amount of developer 102 transported to the region at which developer carrier 111 confronts the image carrier 101 (hereinafter referred to as "developing region"). The developer 102 regulated by regulating member 113 is supplied to the developing region, and develops an electrostatic latent image formed on the image carrier 101.

As shown in FIG. 5, a direct current (DC) and alternating current (AC) from DC power source 114 and AC power source 115 are superimposed and supplied to developer carrier 111, so as to generate an electric field in which an AC electric field is superimposed on a DC electric field in the developing region to accomplish development. This electric field is effective for developing an electrostatic latent image formed on image carrier 101, and prevents disruption of a toner image formed on image carrier 101 by a magnetic brush of developer 102.

When a halftone image is developed by a method using the action of an electric field comprising an AC electric field superimposed on a DC electric field in a developing region, there is marked variation of image density due to variations in surface potential of image carrier 101 relative to the halftone image, which disadvantageously produces irregular density in the image so as to prevent obtaining images having excellent balance. Images formed in this way also lack adequate texture.

In recent years it has been proposed, as disclosed in U.S. Pat. No. 4,610,531, to utilize the action of an electric field comprising an AC electric field superimposed on a DC electric field in a developing region by alternatingly repeating a first time period t1 (action period) during which an AC voltage is applied between a developer carrier 111 and an image carrier 101 and a second time period t2 (rest period) during which said AC voltage is not applied so as to provide a pair of AC electric field of opposite direction in first action period t1, and use the final component of said AC electric field as an electric field component normally to pull back developer 102 to the developer carrier 111 when accomplishing development.

In this instance, however, developer 102 continues to be pulled back to the developer carrier 111 even during the second action period t2 when the said second action period t2 is entered after the AC electric field stops in the state in which said developer 102 is normally pulled back to the developer carrier 111 from the image carrier 101 while said developer 102 is traveling between said image carrier 101 and developer carrier 111. Therefore, when the AC electric field is subsequently applied, the developer 102 is inadequately supplied to the image carrier 101, thereby reducing the image density of the formed image, and preventing the production of images having suitable density in the case of high-speed developing.

SUMMARY OF THE INVENTION

An abject of the present invention is to eliminate the aforesaid various disadvantages by providing a developing device which accomplishes developing by applying an AC voltage between a developer carrier and an image carrier.

That is, an object of the present invention is to provide a developing device capable of producing images having excellent image density and texture without density irregularities.

The present invention relates to a developing device comprising a developer carrier disposed opposite the image carrier and transporting a developer held on its surface to a developing region and a voltage supplying unit which applies an alternating current voltage to the developer carrier, said alternating current voltage having a first frequency during a first action period and a second frequency during a second action period, the first action period and the second action period being alternately repeated, the second frequency being higher than the first frequency.

That is, developer oscillates between the developer carrier and the image carrier via an AC electric field produced by an AC voltage applied during the first action period so as to supply developer to an electrostatic latent image formed on said image carrier. On the other hand, only a slight amount of developer oscillates via the AC electric field generated in the second action period compared to the first action period so as to produce images having excellent texture without density irregularities.

BRIEF DESCRIPTION OF THE DRAWINGS

FIG, 4 shows another example of an embodiment of the developing device of the present invention wherein an AC voltage is applied between a developer carrier and an image carrier such that the frequency of the AC voltage applied during the second action period T2 is greater than the frequency of the AC voltage applied during the first action period T1.

DESCRIPTION OF THE PREFERRED EMBODIMENTS

The preferred embodiments of the developing device of the present invention are described hereinafter with reference to the accompanying drawings.

Figure 1:
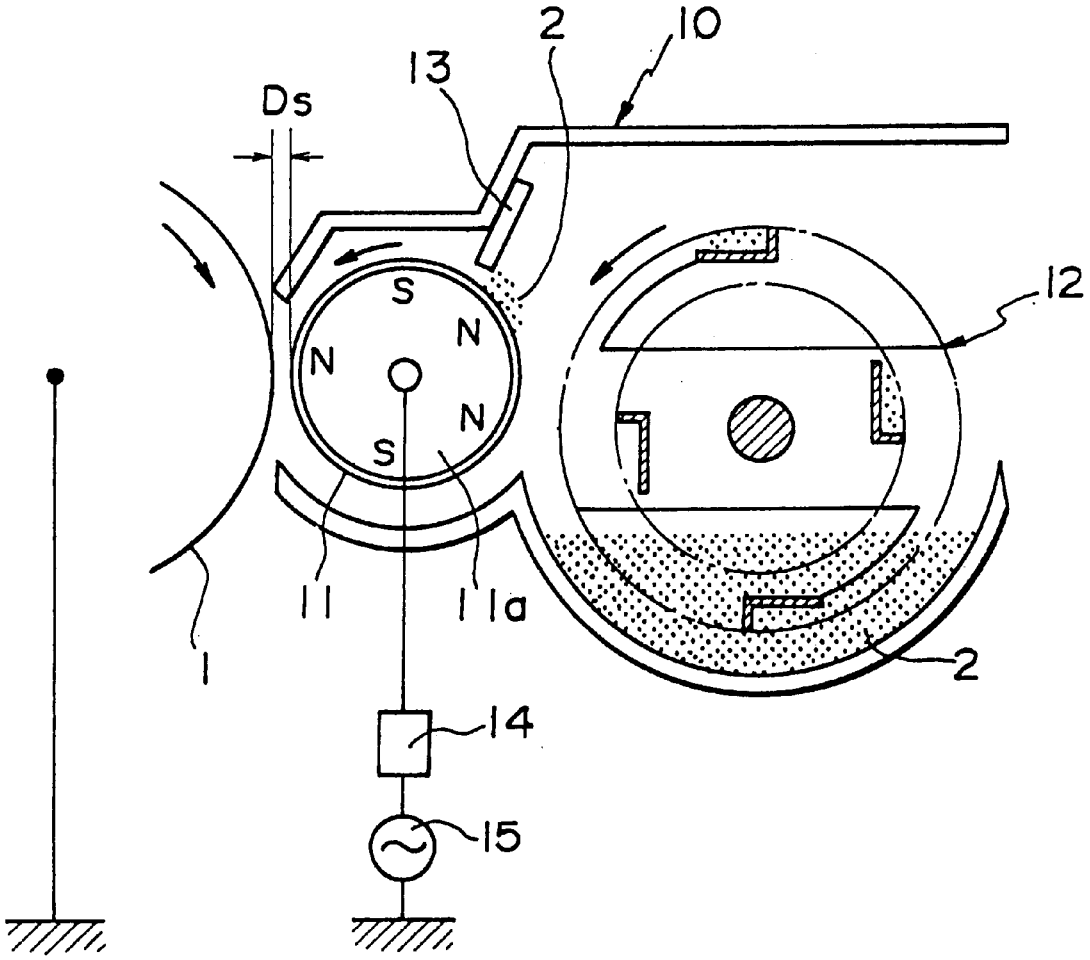
FIG. 1 briefly shows the construction of one embodiment of the developing device of the present invention.
Figure 2:
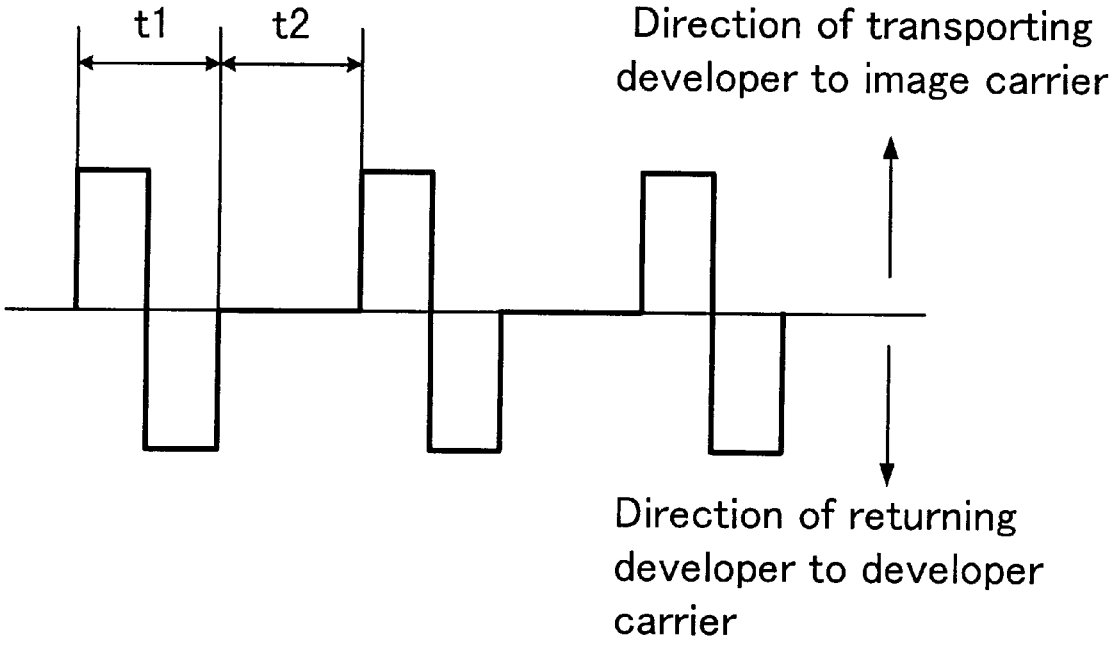
FIG. 2 illustrates the conditions in a conventional developing device of alternately repeating a first action period t1 during which an AC voltage is applied between a developer carrier and an image carrier and a second action period t2 during which an AC voltage is not applied therebetween.

FIG. 1 shows an embodiment of the developing device of the present invention. In body 10 of the developing device is provided a cylindrical developer carrier 11 having an internal magnet roller 11*a* disposed opposite an image carrier 1. A developer supplying member 12 such as a bucket roller or the like supplies developer 2 accommodated in body 10 to the surface of developer carrier 11. Developer 2 is maintained on the surface of developer carrier 11 by the magnetic force of magnet roller 11*a*, and is transported via the rotation of developer carrier 11. Regulating member 13 regulates the amount of developer 2 transported to a region at which developer carrier 11 con fronts an image carrier 1 (hereinafter referred to as "developing region"). Developer 2 which has been regulated by regulating member 13 is supplied to the developing region and develops an electrostatic latent image formed on image carrier 1.

A voltage comprising an alternating current (AC) voltage from AC power source 15 superimposed on a direct current (DC) voltage from DC power source 14 is supplied to developer carrier 11 to accomplish developing via the action of an electric field comprising an AC electric field superimposed on a DC electric field in the developing region.

Figure 3:
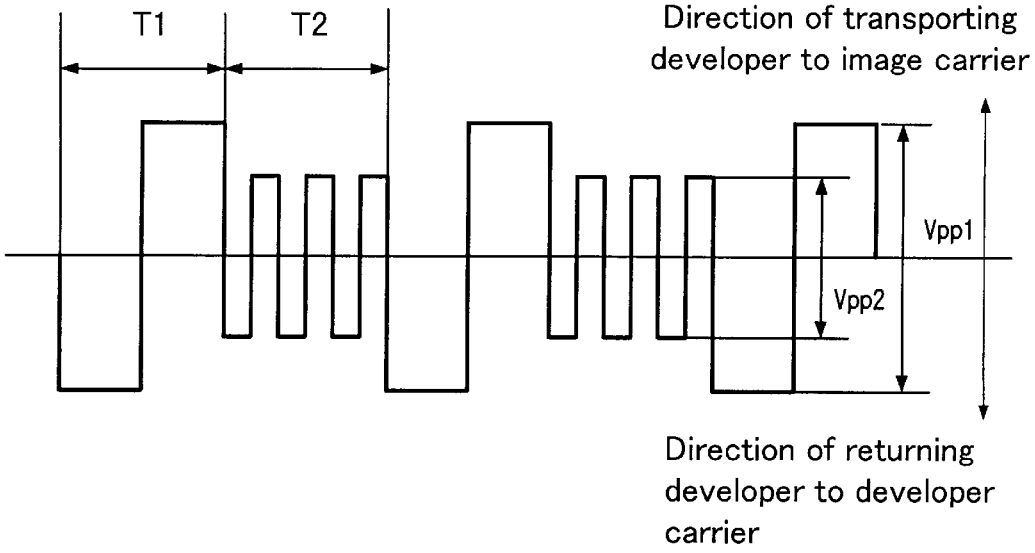
FIG. 3 illustrates an example of an embodiment of the developing device of the present invention wherein an AC voltage is applied between a developer carrier and an image carrier such that the frequency of the AC voltage applied during the second action period T2 is greater than the frequency of the AC voltage applied during the first action period T1.
Figure 4:
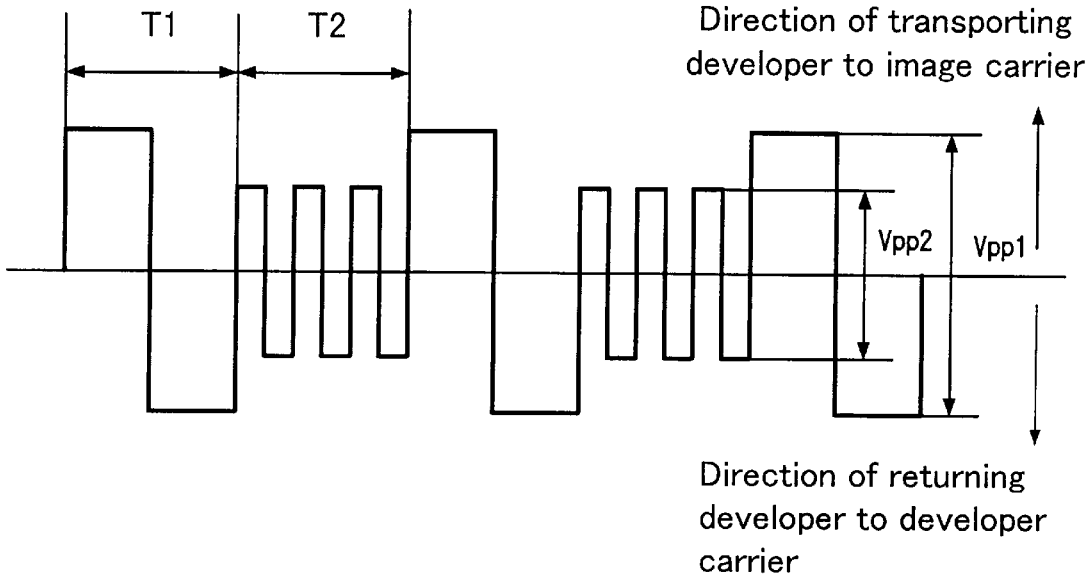
Figure 5:
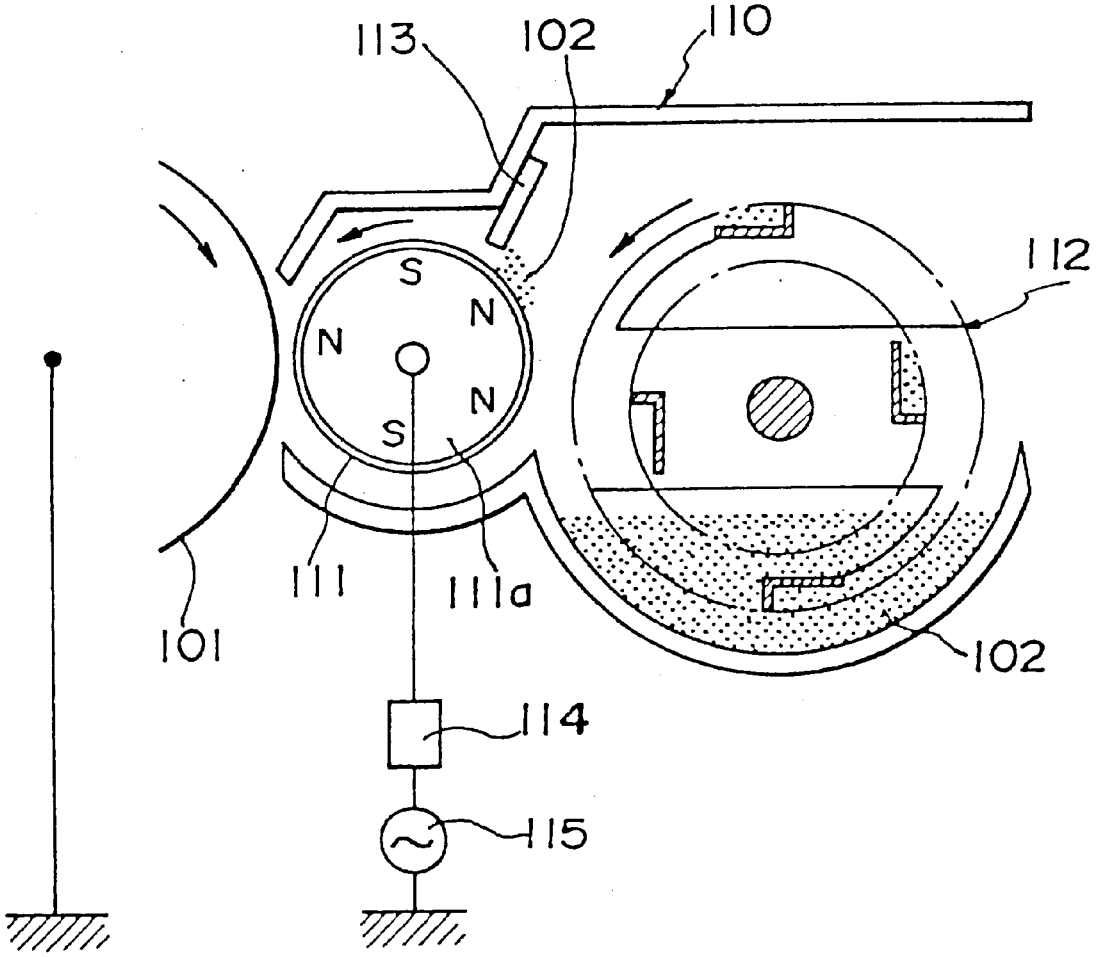
FIG. 5 briefly shows the construction of a conventional developing device.

In the developing device of the aforesaid embodiment, as shown in FIGS. 3 and 4, the AC voltage applied by AC power source 15 changes during the first action period T1 and second action period T2 so as to supply a higher frequency AC voltage during the second action period T2 than the frequency of the AC voltage during the first action period T1, and supply an AC voltage during the second time period T2 which has a peak-to-peak value Vpp2 which is lower than the peak-to-peak value Vpp1 of the AC voltage applied in the first action period T1.

In he developing device of the present embodiment, there is scant leakage of current between the developer carrier 11 and the image carrier 1 during development so as to produce images having excellent texture with negligible density irregularities.

Density of images is particularly improved when the direction of the electric field generated by the final component of the AC voltage applied during first action period T1 ends in the direction of transporting developer to the image carrier, such that only a small amount of developer oscillates during the second action period T2 with developer traveling to the image carrier, as shown in FIG. 3.

In the aforesaid developing device, the amount of developer transported to the developing region by the developer carrier is 0.5 to 10 mg/cm$^2$, and preferably 1 to 7 mg/cm$^2$ from the perspective of preventing a reduction in image density and preventing carrier adhesion.

Although either a monocomponent developer or two-component developer may be used, a two-component developer is desirable. It is further desirable that the carrier used in a two- component developer will have a volume-average particle size of 20 to 50 $\mu$m, and preferably 25 to 45 $\mu$m from the perspective of preventing carrier adhesion and preventing irregular density. Such carrier includes such suitable carriers as binder-type carriers having magnetic microparticles dispersed in a binder resin, and coated carriers of magnetic particles with a surface coating of resin. Suitable toners will have a volume-average particle size of 3 to 12 $\mu$m, and preferably 4 to 9 $\mu$m.

Experiments were performed using the developing device of FIG. 1 and varying the AC voltage applied between the developer carrier 11 and the image carrier 1. When the developing de ice of the aforesaid embodiment was used for developing, the obtained images clearly had excellent texture and we re without density irregularities.

Examples 1 to 9

In the developing devices of examples 1 to 9, the developer used comprised a binder-type carrier having a volume-average particle size of about 30 $\mu$m, and a toner having a volume-average particle size of about 8 $\mu$m mixed to achieve a toner concentration of 13 percent-by-weight.

In the developing devices of examples 1 to 9, developing was accomplished by charging the aforesaid image carrier 1 from an initial surface potential Vo to −450 V via a charger not shown in the drawings, and subsequently exposing said charged image carrier to optical exposure to achieve a surf ace potential of −100 V in the exposure region.

The amount of developer 2 transported by said developer carrier 11 to the developing region opposite the image carrier 1 was set at 5 mg/cm$^2$. A DC voltage Vb of −350 V was supplied by the DC power source 14. In examples 1 to 9, various different AC voltages were supplied by the AC power source 15, and developing was accomplished by means of the action of an electric field comprising an AC electric field superimposed on a DC electric field.

Although different AC voltages are supplied from the aforesaid AC power source, in all of the examples below the peak-to-peak voltage Vpp1 applied during the first action period T1 was 1.6 kV and a square waveform having a frequency of 3 kHz was applied in a single cycle, such that the direction of the AC voltage in the final action of the first action period T1 was in the direction transporting developer 2 to the image carrier 1, as shown in FIG. 3.

In the second action period T2, however, the condition of the AC voltage supplied by the AC power source 15 was varied so that no AC voltage was supplied by AC power source 15 in example 1, and in examples 2 to 6, various AC voltages comprising square waveforms having a peak-to-peak voltage Vpp2 of 0.8 kHz and frequencies of 1.5, 3, 6, 9, and 12 kHz were supplied for the same period as the first action period T1, and in examples 7 to 10 various AC voltages comprising square waveforms having a peak-to-peak value Vpp2 of 0.3, 1.2, and 1.4 kV and frequency of 9 kHz were supplied for the same period as the first action period T1, so as to accomplish developing by alternately repeating said first action period T1 and said second action period T2, as shown in Table 1 below.

A Macbeth densitometer was used to measure image density of the images formed using the developing devices of examples 1 to 9, and the obtained images were evaluated for texture and density irregularities; evaluation results are shown below in Table 1.

Texture was rated 5 for very good texture, 4 for good texture, 3 for texture which did not pose a problem in practical use, 2 for poor texture which did pose a problem practical use, and 1 for very poor texture. Density irregularity was rated 5 for very good density without irregularities, 4 for good density, 3 for density which posed no problem for practical use, 2 for poor density which did pose a problem for practical use, and 1 for very poor density.

TABLE 1

| Ex | 1st Action Period | | 2nd Action Period | | | | Irregu- |
|---|---|---|---|---|---|---|---|
| am-ple | Frequency (kHz) | Vpp1 (kV) | Frequency (kHz) | Vpp2 (kV) | Image Density | Texture | larity Density |
| 1 | 3 | 1.6 | 0 | 0 | 1.26 | 3 | 4 |
| 2 | 3 | 1.6 | 1.5 | 0.8 | 1.30 | 3 | 1 |
| 3 | 3 | 1.6 | 3 | 0.8 | 1.36 | 3 | 2 |
| 4 | 3 | 1.6 | 6 | 0.8 | 1.43 | 4 | 4 |
| 5 | 3 | 1.6 | 9 | 0.8 | 1.41 | 4 | 4 |
| 6 | 3 | 1.6 | 12 | 0.8 | 1.42 | 5 | 4 |
| 7 | 3 | 1.6 | 9 | 0.3 | 1.35 | 4 | 4 |
| 8 | 3 | 1.6 | 9 | 1.2 | 1.43 | 4 | 4 |
| 9 | 3 | 1.6 | 9 | 1.4 | 1.44 | 4 | 4 |

In the case of developing accomplished by the developing devices of examples 4 to 9 wherein the frequency of the AC voltage applied in the second action period T2 was greater than the frequency of the AC voltage applied in the first action period T1, the obtained images were invariably superior in texture with minimal density irregularity compared to developing accomplished by the developing devices of examples 1 to 3 which did not satisfy the conditions of the present invention.

Furthermore, in examples 4 to 9, the improvement of texture of the obtained image was greater as the frequency of the AC voltage applied in the second action period T2 inc eased, and the image density of the obtained image increase d as the peak-to-peak value Vpp2 of the AC voltage applied in the second action period T2 increased and approached the peak-to-peak value Vpp1 of the AC voltage applied in the first action period T1. Leakage occurred between the developer carrier 11 and the image carrier 1 when the peak-to-peak value Vpp2 of the AC voltage applied in the second action period became excessively high.

Examples 10 to 17

In examples 10 to 17, a varied AC voltage was supplied between n the developer carrier 11 and image carrier 1 by the AC power source 15, as in examples 1 to 9, and a square waveform having a frequency of 3 kHz and a peak-to-peak value Vpp1 in the first action period T1 of 1.6 kV was supplied for one cycle, such that the direction of the final AC voltage acting in the first action period T1 was the direction to return the developer 2 to the developer carrier 11.

In the second action period T2, however, the condition of the AC voltage supplied from the AC power source 15 was varied, such that various AC voltages comprising square waveforms having a peak-to-peak voltage Vpp2 of 0.8 kHz and frequencies of 1.5, 3, 6, 9, and 12 kHz were supplied for the same period as the first action period T1 in examples 10 to 14, and in examples 15 to 17 various AC voltages comprising square waveforms having a peak-to-peak value Vpp2 of 0.3, 1.2, and 1.4 kV and frequency of 9 kHz were supplied for the same period as the first action period T1, so as to accomplish developing by alternately repeating said first action period T1 and said second action period T2, as shown in Table 2 below.

A Macbeth densitometer was used to measure the image density of the images formed using the developing devices of examples 10 to 17, and the obtained images were visually evaluated for texture and density irregularities in the same manner as in examples 1 to 9; evaluation results are shown below in Table 2.

TABLE 2

| Ex | 1st Action Period | | 2nd Action Period | | | | Irregu- |
|---|---|---|---|---|---|---|---|
| am-ple | Frequency (kHz) | Vpp1 (kV) | Frequency (kHz) | Vpp2 (kV) | Image Density | Texture | larity Density |
| 1 | 3 | 1.6 | 0 | 0 | 1.26 | 3 | 4 |
| 10 | 3 | 1.6 | 1.5 | 0.8 | 1.28 | 3 | 1 |
| 11 | 3 | 1.6 | 3 | 0.8 | 1.32 | 3 | 2 |
| 12 | 3 | 1.6 | 6 | 0.8 | 1.34 | 4 | 4 |
| 13 | 3 | 1.6 | 9 | 0.8 | 1.32 | 4 | 4 |
| 14 | 3 | 1.6 | 12 | 0.8 | 1.32 | 5 | 4 |
| 15 | 3 | 1.6 | 9 | 0.3 | 1.28 | 4 | 4 |
| 16 | 3 | 1.6 | 9 | 1.2 | 1.34 | 4 | 4 |
| 17 | 3 | 1.6 | 9 | 1.4 | 1.35 | 4 | 4 |

In the case of developing accomplished by the developing devices of examples 12 to 17 wherein the frequency of the AC voltage applied in the second action period T2 was greater than the frequency of the AC voltage applied in the first action period T1, the obtained images were invariably superior in texture with minimal density irregularity compared to developing accomplished by the developing devices of examples 1, 10, and 11 which did not satisfy the conditions of the present invention.

Furthermore, in examples 12 to 17, the improvement of texture of the obtained image was greater as the frequency of the AC voltage applied in the second action period T2 increased, and the image density of the obtained image increased as the peak-to-peak value Vpp2 of the AC voltage applied in the second action period T2 increased and approached the peak-to-peak value Vpp1 of the AC voltage applied in the first action period T1. Leakage occurred between the developer carrier 11 and the image carrier 1 when the peak-to-peak value Vpp2 of the AC voltage applied in the second action period became excessively high.

Comparison of examples 4 to 9 and examples 12 to 17 discloses that high image density was obtained in the images produced by examples 4 to 9 wherein the direction of the final AC voltage acting during the first action period T1 is the direction for moving developer 2 to the image carrier 1 compared to examples 12 to 17 wherein the direction of the final AC voltage acting during the first action period T1 is the direction for returning developer 2 to the developer carrier 11.

Although the present invention has been fully described by way of examples with reference to the accompanying drawings, it is to be noted that various changes and modification will be apparent to those skilled in the art. Therefore, unless otherwise such changes and modifications depart from the scope of the present invention, the should be construed as being included therein.

What is claimed is:

1. A developing device for developing electrostatic latent images formed on an image carrier, comprising:

a developer carrier disposed opposite the image carrier and transporting a developer held on its surface to a developing region; and a voltage supplying unit which applies an alternating current voltage to the developer carrier, said alternating current voltage having a first frequency during a first action period that includes at least one complete cycle of the alternating current and a second frequency during a second action period, the first action period and the second action period being alternately repeated, the second frequency being higher than the first frequency.

2. The developing device according to claim 1, wherein a second peak-to-peak value of the alternating current voltage during the second action period is lower than a first peak-to-peak value of the alternating current voltage during the first action period.

3. The developing device according to claim 1, wherein a direction of an electric field generated by a final component of the alternating current voltage during the first action period is a direction of transporting the developer to the image carrier.

4. The developing device according to claim 1, wherein a direction of an electric field generated by a final component of the alternating current voltage during the first action period is a direction of returning the developer to th developer carrier.

5. The developing device according to claim 1, wherein the voltage supplying unit applies a direct current voltage to the developer carrier.

6. The developing device according to claim 1, wherein the developer comprises a toner having a volume-average particle size of 3 to 12 $\mu$m and a carrier having a volume-average particle size of 20 to 50 $\mu$m.

7. The developing device according to claim 6, wherein the toner has a volume-average particle size of 4 to 9 $\mu$m.

8. The developing device according to claim 6, wherein the carrier comprises a binder resin and magnetic particles dispersed in the binder resin.

9. The developing device according to claim 1, wherein an amount of developer transported to the developing region by the developer carrier is 0.5 to 10 mg/cm$^2$.

10. The developing device according to claim 1, wherein an amount of developer transported to the developing region by the developer carrier is 1 to 7 mg/cm$^2$.

11. A developing device for developing electrostatic latent images formed on an image carrier, comprising:

a developed carrier disposed opposite the image carrier and transporting a developer held on its surface to a developing region; and a voltage supplying unit which applies a bias voltage to the developer carrier, said bias voltage having a first action period during which is applied a first alternating current voltage and a second action period during which is applied a second alternating current voltage, the first action period and the second action period being alternately repeated, the second alternating current voltage having a second frequency which is higher than a first frequency of the first alternating current voltage, and in the first action period and in the second action period a same direct current bias voltage is applied so that a central voltage of the first alternating current voltage corresponds with a central voltage of the second a terminating current voltage.

12. The developing device according to claim 11, wherein a second peak-to-peak value of the second alternating current voltage is lower than a first peak-to-peak value of the first alternating current voltage.

13. The developing device according to claim 11, wherein a direction of n electric field generated by a final component of the first alternating current voltage is a direction of transporting the developer to the image carrier.

14. The developing device according to claim 11, wherein a direction of an electric field generated by a final component of th first alternating current voltage is a direction of returning the developer to the developer carrier.

15. A method for developing electrostatic latent images formed on an image carrier, comprising the steps of:

forming the electrostatic latent images on the image carrier;

transporting a developer to a developing region formed between the image carrier and a developer carrier; and developing the electrostatic latent images by the developer under an exertion of an alternating current voltage having a first action period that includes at least one complete cycle of the alternating current and a second action period which are alternately repeated, a second frequency of the alternating current voltage exerted during the second action period beaming higher than a first frequency of the alternating current voltage exerted during the first action period.

16. The method according to claim 15, wherein a second peak-to-peak value of the alternating current voltage during the second action period is lower than a first peak-to-peak value of the alternating current voltage during the first action period.

17. The method according to claim 15, wherein a direction of an electric field generated by a final component of the alternating current voltage during the first action period is a direction of transporting the developer to the image carrier.

18. The method according to claim 15, wherein a direction of an electric field generated by a final component of the alternating current voltage during the first action period is a direction of returning the developer to the developer carrier.

19. The method according to claim 15, wherein the developing step is performed under a direct current voltage.

20. The method according to claim 15, wherein the developer comprises a toner having a volume-average particle size of 3 to 12 $\mu$m and a carrier having a volume-average particle size of 20 to 50 $\mu$m.

21. The method according to claim 20, wherein the toner has a volume-average particle size of 4 to 9 $\mu$m.

22. The method according to claim 20, wherein the carrier comprises a binder resin and magnetic particles dispersed in the binder resin.

23. The method according to claim 15, wherein an amount of developer transported to the developing region by the developer carrier is 0.5 to 10 mg/cm$^2$.

24. The method according to claim 15, wherein an amount of developer transported to the developing region by the developer carrier is 1 to 7 mg/cm$^2$.

* * * * *